United States Patent [19]

Andre et al.

[11] 4,237,969

[45] Dec. 9, 1980

[54] HEAT TRANSFER ELEMENT TO REPLACE ELECTRICAL HEATING ELEMENT

[75] Inventors: Willard E. Andre, Cypress; Andrew Clausen, Jr., Whittier; Ben B. Hultsman, Covina, all of Calif.

[73] Assignee: Southern California Gas Company, Los Angeles, Calif.

[21] Appl. No.: 40,780

[22] Filed: May 21, 1979

[51] Int. Cl.[3] ..... F24H 9/16; F28F 13/06; F28D 1/04

[52] U.S. Cl. ..... 165/71; 165/97; 165/103; 165/132; 165/157; 165/163

[58] Field of Search ..... 165/154, 172, 162, 71, 165/101, 97, 150, 151, 174, 173, 175, 103, 132, 157, 163

[56] References Cited

U.S. PATENT DOCUMENTS

| | | | |
|---|---|---|---|
| 1,551,076 | 8/1925 | Thill | 165/97 |
| 2,813,700 | 11/1957 | Schenck, Jr. | 165/175 |
| 2,924,438 | 2/1960 | Malkoff | 165/150 |
| 3,782,451 | 1/1974 | Cates | 165/71 |
| 3,962,999 | 6/1976 | Rehm | 165/71 |
| 3,990,504 | 11/1976 | Kolthoff, Jr. | 165/97 |

FOREIGN PATENT DOCUMENTS

| | | | |
|---|---|---|---|
| 2450687 | 4/1976 | Fed. Rep. of Germany | 165/103 |
| 414405 | 7/1946 | Italy | 165/175 |

*Primary Examiner*—Sheldon Richter
*Attorney, Agent, or Firm*—Bruce L. Birchard

[57] ABSTRACT

A novel heat transfer element which permits simple, low-cost conversion of energy inefficient electrically heated water heaters to energy efficient potable-water storage tanks for storing water heated by energy-efficient gas-fired water heating systems.

4 Claims, 4 Drawing Figures

HEAT TRANSFER ELEMENT TO REPLACE ELECTRICAL HEATING ELEMENT

BACKGROUND OF THE INVENTION

1. Field of the Invention

This invention relates to heat transfer elements and more particularly to heat transfer elements adapted to increase energy use efficiency.

2. Prior Art

A search of the prior patent art revealed the following patents related to, but not anticipatory of the present invention:

U.S. Pat. No. 2,068,955 (Krutzer, et al) issued Jan. 26, 1937, is directed to vaporization of a refrigerant in a cooling system and, specifically, to a spiral metal ribbon inserted in a conventional finned-tube evaporator coil to change the liquid-vapor conditions and to improve the heat-transfer capability of the system. This patent fails to show a liquid-to-liquid heat transfer element which can be used to convert an energy-inefficient electric hot water heating system into an energy efficient gas-fired potable water heating system.

U.S. Pat. No. 3,080,916 (Collins) issued Mar. 12, 1963, is directed to an air-to-liquid heat transfer coil in which the finned-tube coil is designed with a precise relationship between tubes to improve air-to-tube surface exposure and, consequently, heat transfer. This patent fails to show a liquid-to-liquid heat transfer element which is capable of converting an energy inefficient electrically powered hot water into a potable-water storage tank for an energy-efficient gas-fired heating system.

U.S. Pat. No. 2,924,438 (Malkoff) issued Feb. 9, 1960, is directed to an insert tube designed to change the liquid flow characteristics in existing heating coils so as to eliminate internal air accumulation. This patent fails to show a heat transfer element designed to convert any electric hot water heater into a storage tank for potable water heated by the transfer element as a result of boiler water heated by a gas-fired burner in an energy-efficient system.

U.S. Pat. No. 4,053,014 (Neff, et al) issued Oct. 11, 1977, shows an air-to-liquid heat exchanger coil of aluminum in which the problem of sealing the aluminum system is simplified by a particular arrangement of tubes and headers. It does not show a liquid-to-liquid heat transfer element that can convert any electric hot water heater to a potable hot water heater for an energy-efficient gas-fired heating system.

U.S. Pat. No. 4,071,078 (Padden) which was issued Jan. 31, 1978, is directed to a hydronic heating system utilizing conventional heat transfer elements and does not show or suggest the novel heat transfer element of this invention which is capable of converting any hot water heater into the storage tank for potable hot water in a gas-fired system.

U.S. Pat. No. 2,707,868 (Goodman) which was issued May 10, 1955, is directed to a refrigeration system and a mixing valve for that system. It does not show or suggest the heat exchanger element of this invention which is capable of converting an electric hot water heater into the hot water storage tank for an energy-efficient gas-fired heating system.

Existing "all-electric" houses and houses with hybrid heating systems, i.e. electric hot water heaters and gas-fired, forced-air space heating systems are highly energy-inefficient. Further, the cost of operating such systems has become prohibitive. As a result, mini-boiler systems have been developed which rely upon gas-fired boilers and small-bore tubing hydronic systems to provide both space heating and water heating requirements. Up until the time of this invention, existing hot-water heaters, which are energy inefficient, have been discarded and replaced by new hot water storage tanks (which is material and energy wasteful) or water continued to be heated electrically, which is unnecessarily wasteful and expensive.

Therefore, it is an object of this invention to overcome the problems hereinbefore set forth.

It is a further object of this invention to provide means for conserving energy and material in converting energy-inefficient heating systems into energy efficient ones.

SUMMARY OF THE INVENTION

Stated succinctly, this invention provides a thin-walled tube single or multiple-pass immersion heat transfer element which is designed to fit within an electric hot-water heater tank after the removal of the electrical heating element therefrom and to have its input and output connectors spaced to fit the openings remaining in the tank after the electrical heating element is removed. Liquid-sealing means support the heat-transfer element in the tank and drain means are provided to permit selective draining of the element in the event of leakage of fluid from the element so that pollution of the potable water surrounding the element can be prevented.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description taken in conjunction with the accompanying drawings, in which:

DETAILED DESCRIPTION OF THE PREFERRED EMBODIMENTS

Figure 1:
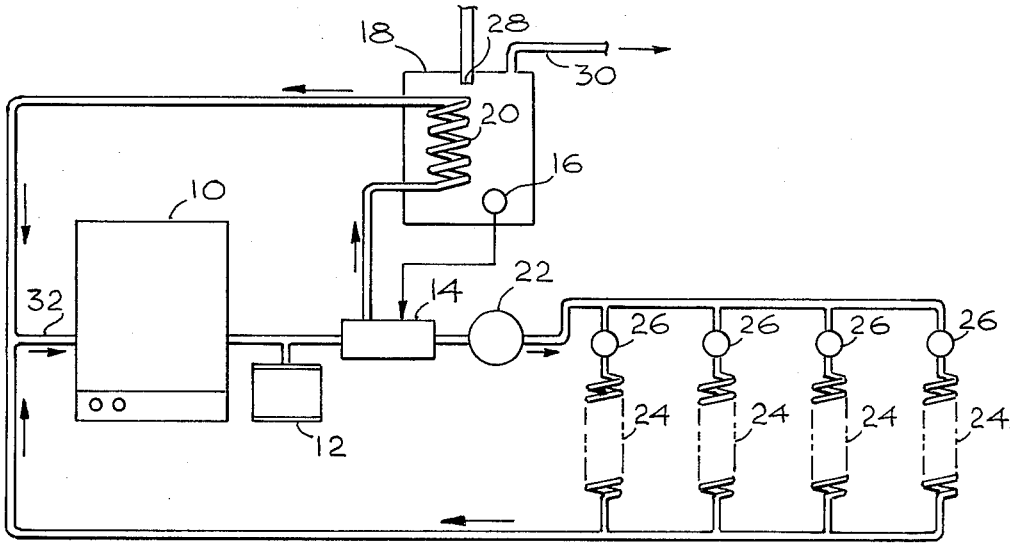
FIG. 1 is a schematic diagram of a heating system incorporating this invention.
Figure 2:
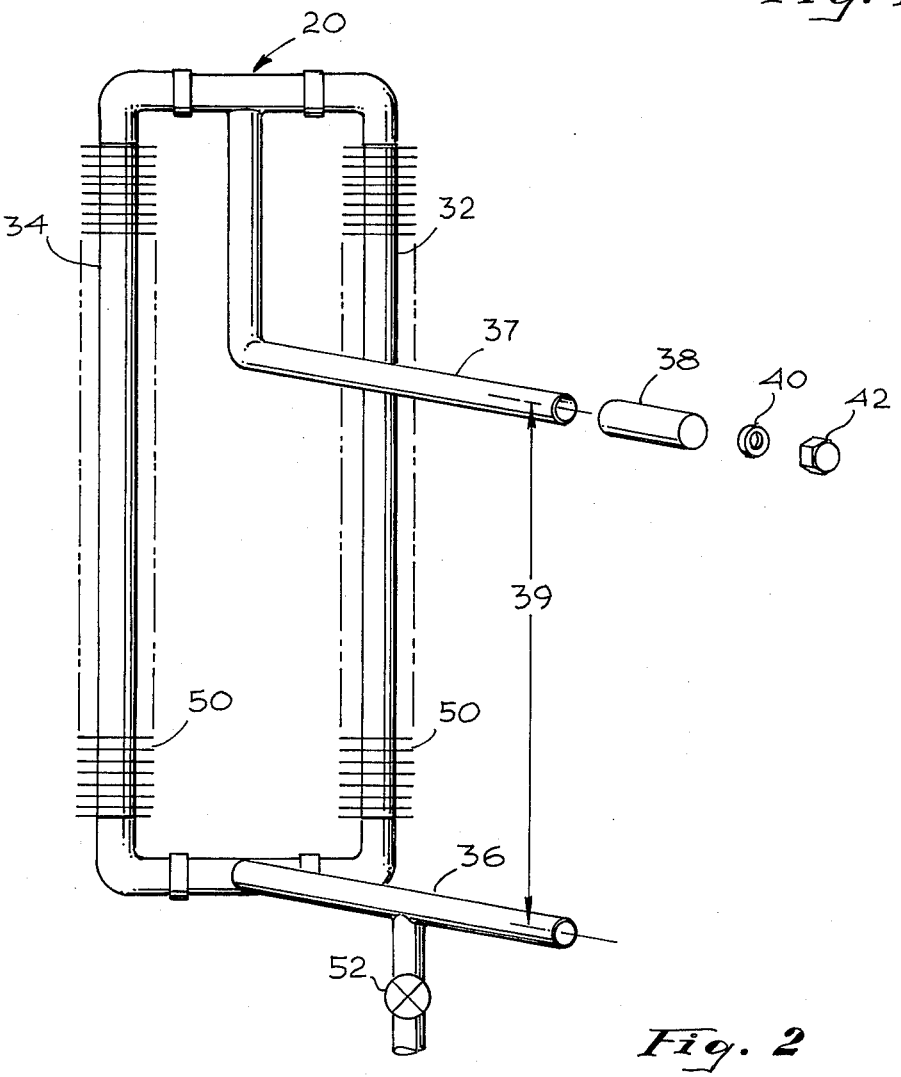
FIG. 2 is an elevational view of a two-tube version of the heat transfer element according to the present invention.

In FIG. 2, boiler 10, which is gas-fired, is a compact boiler which may be hung in any location with an outside wall, for example, in a laundry room closet, basement or under the stairs. It has a balanced flue, installed through an outside wall, which brings in combustion air and discharges products of combustion, thus eliminating the need for roof vents which cause heat loss. The boiler water capacity is only 7–8 pints which results in reaching desired water temperatures quickly and reduced heat-loss on cool-down.

Expansion tank 12 is provided to assure safety for the system.

Controller 14 responds to commands from thermostat 16 in hot water storage cylinder 18 to control the quantity of hot water flowing through heat transfer element 20.

Pump 22 provides heated boiler water to convectors 24 through thermostatically controlled valves 26.

Potable water is introduced into tank 18 through inlet 28. After the water is heated by heat transferred from element 20 it passes out of outlet 30, on demand. There is no mixing of boiler water and potable water. Return water from element 20 and from convectors 24 enters boiler 10 at inlet 32, making a closed loop in the heating water system.

All of the heat from element 20 goes directly to the stored potable water resulting in a more-energy-efficient system than is realized with conventional water heaters, particularly electric water heaters. There is no fluid loss from tank 18.

There exist many electric water heaters in use and there has been industry built around electrical hot water heaters. The mini-boiler system just described would tend to obsolete electric water heaters and the industry and people involved in their manufacture. According to this invention, such obsolescence and the waste associated with it can be avoided. Electrical hot water heaters have an electrical heating element supported inside them from two openings having a standard separation distance. After removal of the electrical heating element from an existing electrical hot water heater or before the installation of that element, the heat transfer element according to this invention may be substituted directly to effect an energy-saving modification.

One such element is shown in FIG. 2. In FIG. 2, heat transfer element 20 includes a pair of parallel-fed, thin-walled tubes 32 and 34 joined at their lower ends to inlet pipe 36 and at their upper ends to outlet pipe 37. Inlet pipe 36 and outlet pipe 37 are shown as horizontal and substantially parallel to each other. This is the orientation of such pipes for installation in an electrical water heater in which the heating element, prior to its removal, was side mounted in its tank. For such a tank the separation distance 39 between inlet pipe 36 and outlet pipe 37 is equal to the standard separation, center to center, of the side tank openings for the heating element in the electrical water heater. Plastic insulation sleeve 38, plastic compression ferrule 40 and plastic tube nut 42 are provided, at both inlet pipe 36 and outlet pipe 37 to secure element 20 in liquid tight fashion in the tank (not shown) which was previously associated with an electrical hot-water heater.

Fins 50 on tubes 32 and 34 increase the heat-transfer area.

Dump valve 52 is provided in conjunction with inlet pipe 36 to permit dumping of all the liquid in element 20 if element 20 should begin leaking. This safety feature prevents contamination of the potable water surrounding element 20 when that element is installed in a water tank, as previously discussed.

Figure 3:
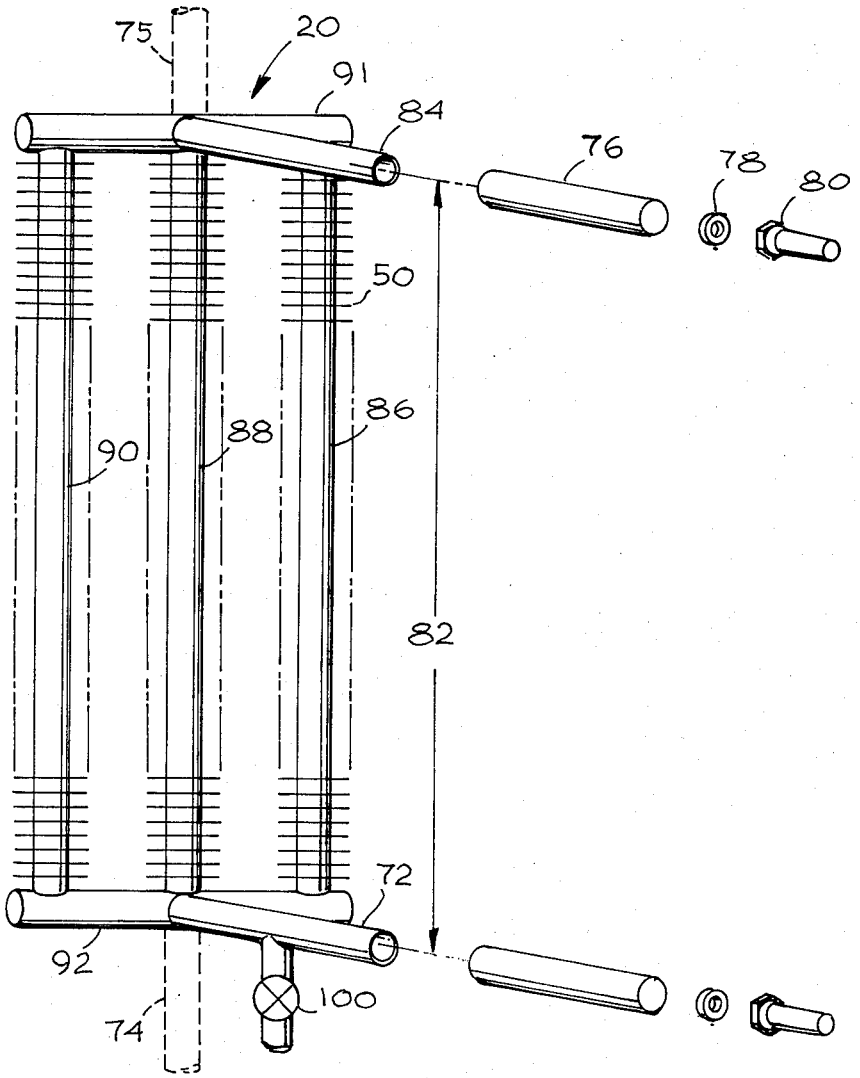
FIG. 3 is an elevational view of a three-tube embodiment of the present invention; and, FIG. 4 is an elevational view of a multiple-pass heat exchanger element according to the present invention.
Figure 4:
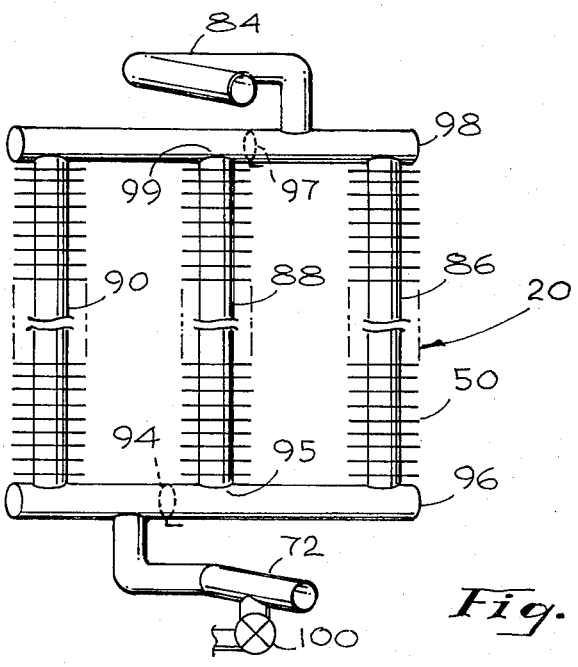

A three-tube version of element 20 (which is adaptable to multiple-pass operation as shown in FIG. 4) is shown in FIG. 3. In FIG. 3 element 20 comprises parallel, thin-walled tubes 86, 88 and 89 which may be disposed in co-planar fashion, as shown, or with their ends lying at the apices of a pair of imaginary parallel triangles.

Inlet pipe 72 is connect to header or manifold 92 which feeds tubes 86, 88 and 90. Those tubes connect at their opposite ends to output manifold 91, which feeds outlet pipe 84. Outlet pipe 84 is separated from inlet pipe 72 by a center-to-center distance 82 which is equal to the spacing of the electrical-heating-element receiving openings in the side-mount version of electrical hot water heater, not shown.

Mounting hardware, comprising plastic insulation tube 76, compression ferrule 78 and plastic-tube nut 80 are provided for both inlet pipe 72 and outlet pipe 84.

For some installations, inlet and outlet pipes 72 and 84 may have a vertical orientation, as is suggested at 74 and 75.

Dump valve 100 is provided at inlet pipe 72 for safety purposes, as described in connection with FIG. 2.

FIG. 4 shows an embodiment of element 20 which is selectively multiple pass or multiple-tube single pass. Thin-walled tubes 86, 88 and 90, with their fins 50 are connected between manifolds 96 and 98. A first valve 94 is provided in inlet manifold 96. It is positioned between tubes 88 and 90 and is externally adjustable to block fluid flow into the lower end 95 of tube 88, or to permit such flow. Inlet pipe 72 joins manifold 96 on the side of valve 94 toward tube 90, as shown.

A similar valve 97 is positioned in manifold 98 between tubes 88 and 86 and is externally adjustable to block the flow of liquid from the upper end 99 of tube 88 to outlet pipe 84. Whe valves 94 and 97 are adjusted to their closed, or blocking, positions hot boiler water flows into inlet 72, up through tube 90, down through tube 88, up through tube 86 and out through outlet pipe 84. This multiple-pass results in greater extraction of heat from the boiler water by the potable water than in the single pass configuration which obtains when gate valves 94 and 97 are open. The flow rate of boiler water is, of course, lower in the single path, multiple pass configuration than it is with multiple-path, single-pass configuration.

While particular embodiments of this invention have been shown and described it should be apparent to those skilled in the are that modifications may be made without departing from the spirit and scope of this invention. It is the intent of the appended claims to cover all such modifications.

What is claimed is:

1. For use in an electrical water heater tank from which the electrical heating element is absent, leaving a pair of openings spaced by a first distance:
   - a liquid-to-liquid, immersible, heat transfer element having an inlet manifold and an outlet manifold;
   - a plurality of parallel, finned, thin-walled tubes joining said inlet and outlet manifolds;
   - an inlet pipe connected to said inlet manifold;
   - an outlet pipe connected to said outlet manifold in parallel relationship to said inlet pipe;
   - said inlet and outlet pipes being horizontal and being spaced by a distance equal to said first distance; and,
   - a dump valve connected to said inlet pipe for selectively releasing any liquid from said heat transfer element.

2. Apparatus according to claim 1 in which there are first, second and third thin-walled tubes, a first gate valve carried in said input manifold between said first and second tubes and a second gate valve carried in said output manifold between said second and third tubes.

3. Apparatus according to claim 2 in which said gate valves are adjustable externally to said respective manifolds.

4. Apparatus according to claim 1 in which said tubes are co-planar.

* * * * *